US007772957B2

(12) United States Patent
Chen et al.

(10) Patent No.: US 7,772,957 B2
(45) Date of Patent: Aug. 10, 2010

(54) STRUCTURE OF TRANSFORMER

(75) Inventors: Yi-Lin Chen, Taoyuan Hsien (TW); Hsin-Wei Tsai, Taoyuan Hsien (TW); Bou-Jun Zung, Taoyuan Hsien (TW); Chia-Hung Pai, Taoyuan Hsien (TW); Shih-Hsien Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/334,810

(22) Filed: Dec. 15, 2008

(65) Prior Publication Data

US 2009/0278646 A1 Nov. 12, 2009

(30) Foreign Application Priority Data

May 9, 2008 (TW) ..... 97117254 A
Sep. 17, 2008 (TW) ..... 97135699 A

(51) Int. Cl.
*H01F 27/30* (2006.01)
*H01F 27/24* (2006.01)

(52) U.S. Cl. ..... 336/208; 336/198; 336/212

(58) Field of Classification Search ..... 336/212
See application file for complete search history.

(56) References Cited

U.S. PATENT DOCUMENTS 7,515,026 B1 * 4/2009 Liu et al. ..... 336/192
2007/0273466 A1 * 11/2007 Yang et al. ..... 336/220
2007/0285203 A1 * 12/2007 Ger et al. ..... 336/208
2008/0024262 A1 * 1/2008 Chang et al. ..... 336/208

* cited by examiner

*Primary Examiner*—Anh T Mai
(74) *Attorney, Agent, or Firm*—Kirton & McConkie; Evan R. Witt

(57) ABSTRACT

A transformer includes multiple bobbins arranged side by side, a primary winding coil, a secondary winding coil and a magnetic core assembly. Each bobbin includes a main body, multiple partition plates, a primary winding coil, a secondary winding coil and a magnetic core assembly. The main body has at least two sidewalls respectively disposed at two opposite ends thereof. The partition plates are disposed on the main body for respectively cooperating with the sidewalls to define a first winding region and a second winding region. The first winding region and the second winding region are separated by the partitions plates. The spacer is disposed within the channel. The primary winding coil and the secondary winding coil are respectively wound on the first winding portion and the second winding portion of each bobbin. The magnetic core assembly partially embedded into the channels of the bobbins and sustained against the spacer.

12 Claims, 8 Drawing Sheets

FIG. 1 PRIORART

STRUCTURE OF TRANSFORMER

FIELD OF THE INVENTION

The present invention relates to a structure of a transformer, and more particularly to a structure of a slim-type transformer.

BACKGROUND OF THE INVENTION

A transformer has become an essential electronic component for voltage regulation into required voltages for various kinds of electric appliances.

Since the leakage inductance of the transformer has an influence on the electric conversion efficiency of a power converter, it is very important to control leakage inductance.

In the power supply system of the new-generation electric products such as LCD televisions, leakage inductance transformers (e.g. LLC transformers) prevail. Generally, the current generated from the power supply system will pass through a LC resonant circuit composed of an inductor L and a capacitor C, wherein the inductor L is inherent in the primary winding coil of the transformer. At the same time, the current with a near half-sine waveform will pass through a power MOSFET (Metal Oxide Semiconductor Field Effect Transistor) switch. When the current is zero, the power MOSFET switch is conducted. After a half-sine wave is past and the current returns zero, the switch is shut off. As known, this soft switch of the resonant circuit may reduce damage possibility of the switch, minimize noise and enhance performance.

FIG. 1 is a schematic exploded view of a conventional leakage inductance transformer. The transformer 1 principally comprises a bobbin 11, an upper covering member 12, a magnetic core assembly 13, and a lower covering member 14. A primary winding coil 111 and a secondary winding coil 112 are wound on the bobbin 11. The output terminals 113, 114 of the primary and the secondary winding coils 111, 112 are directly wound and welded on pins 115, which are perpendicularly extended from the bottom of the bobbin 11. The lower covering member 14 is mounted at the bottom of the bobbin 11. The top portion of the bobbin 11 is sheltered by the upper covering member 12. The magnetic core assembly 13 includes two magnetic cores. The middle legs 131 of these two magnetic cores are embedded into a channel 116 of the bobbin 11. The lateral legs 132 of the magnetic core assembly 13 are contacted with each other to enclose the bobbin 11.

As known, the distance between the middle legs 131 of these two magnetic cores of the magnetic core assembly 13 is possibly altered if the transformer 1 is subject to an external force or other actions. Under this circumstance, it is difficult to precisely control the leakage inductance. In addition, since the distances between the lateral legs 132 of the magnetic core assembly 13 and the primary winding coil 111 or the secondary winding coil 112 are very short after the magnetic core assembly 13 is combined with the bobbin 11, the upper covering member 12 is also used to increase the creepage distance between the magnetic core assembly 13, the primary winding coil 111 and the secondary winding coil 112 so as to increase the electric safety. Moreover, a slab element 121 of the upper covering member 12 and a rib 141 of the lower covering member 14 are also used to separate the primary winding coil 111 from the secondary winding coil 112 and thus increase the electric safety distance therebetween.

In other words, the upper covering member 12 and the lower covering member 14 are necessary for increasing the electric safety of the conventional transformer 1. The conventional transformer 1, however, still has some drawbacks. For example, since the conventional transformer 1 has so many components, the process of assembling the transformer 1 is complicated. The upper covering member 12 and the lower covering member 14 also increase the height of the transformer 1, which causes the transformer 1 difficult to conform to the thin tendency. Furthermore, since the output terminals 113, 114 of the primary winding coil 111 and the secondary winding coil 112 are directly wound and welded on the pins 115, a particular length of the wound pin 115 should be reserved. As a consequence, the height of the transformer 1 is also increased. During the winding and welding processes, the integrity of pins 115 also might be adversely affected, and thus the structure strength of the transformer 1 mounted on the circuit board through the pins 115 and even the electrical connection thereof are deteriorated.

Therefore, there is a need of providing an improved structure of a transformer so as to obviate the drawbacks encountered from the prior art.

SUMMARY OF THE INVENTION

It is an object of the present invention to provide a transformer for effectively controlling and increasing leakage inductance, thereby maintaining a desired creepage distance between winding coils and enhancing the electrical safety of the transformer.

Another object of the present invention provides a slim-type transformer with reduced overall height.

A further object of the present invention provides a transformer for increasing integrity of the pins thereof, so that the structure strength of the transformer mounted on the circuit board through the pins is enhanced.

In accordance with an aspect of the present invention, there is provided a transformer. The transformer includes multiple bobbins arranged side by side, a primary winding coil, a secondary winding coil and a magnetic core assembly. Each bobbin includes a main body, multiple partition plates, a primary winding coil, a secondary winding coil and a magnetic core assembly. The main body has at least two sidewalls respectively disposed at two opposite ends thereof. The partition plates are disposed on the main body for respectively cooperating with the sidewalls to define a first winding region and a second winding region. The first winding region and the second winding region are separated by the partitions plates. The channel runs through the sidewalls and the main body. The spacer is disposed within the channel. The primary winding coil is wound on the first winding portion of each bobbin. The secondary winding coil is wound on the second winding portion of each bobbin. The magnetic core assembly partially embedded into the channels of the bobbins and sustained against the spacer.

In accordance with another aspect of the present invention, there is provided a transformer. The transformer includes multiple bobbins arranged side by side, a primary winding coil, a secondary winding coil and a magnetic core assembly. Each bobbin includes a main body, multiple partition plates, a primary winding coil, a secondary winding coil and a magnetic core assembly. The main body has at least two sidewalls respectively disposed at two opposite ends thereof. The partition plates are disposed on the main body for respectively cooperating with the sidewalls to define a first winding region and a second winding region. The first winding region and the second winding region are separated by the partitions plates. The channel runs through the sidewalls and the main body. The spacer is disposed within the channel. The primary winding coil is wound on the first winding portion of each bobbin.

The secondary winding coil is wound on the second winding portion of each bobbin. The magnetic core assembly comprising a first magnetic core and a second magnetic core. Each of the first magnetic core and the second magnetic core includes a core base and several core legs. The core legs are perpendicular to the core base. The core legs are partially embedded into the channels of the bobbins and sustained against the spacers. The insulating article is partially sheathed around the core base.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention relates to a slim-type transformer with reduced coupling coefficient and increased leakage inductance. The transformer of the present invention is applied to a power supply apparatus of a new-generation electric product such as a LCD television. An exemplary transformer is a LLC transformer for controlling the resonant circuit of the power supply apparatus.

Figure 1:
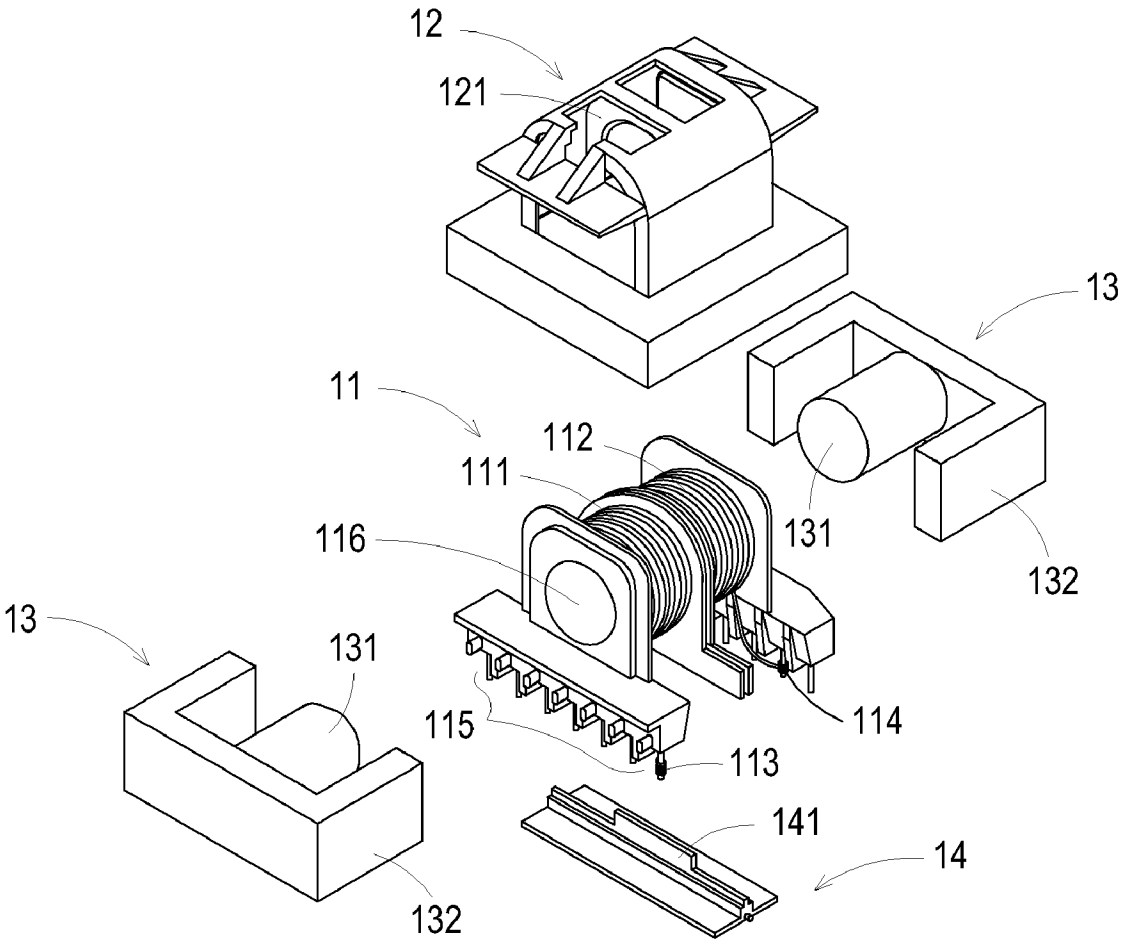
FIG. 1 is a schematic exploded view of a conventional leakage inductance transformer.
Figure 2:
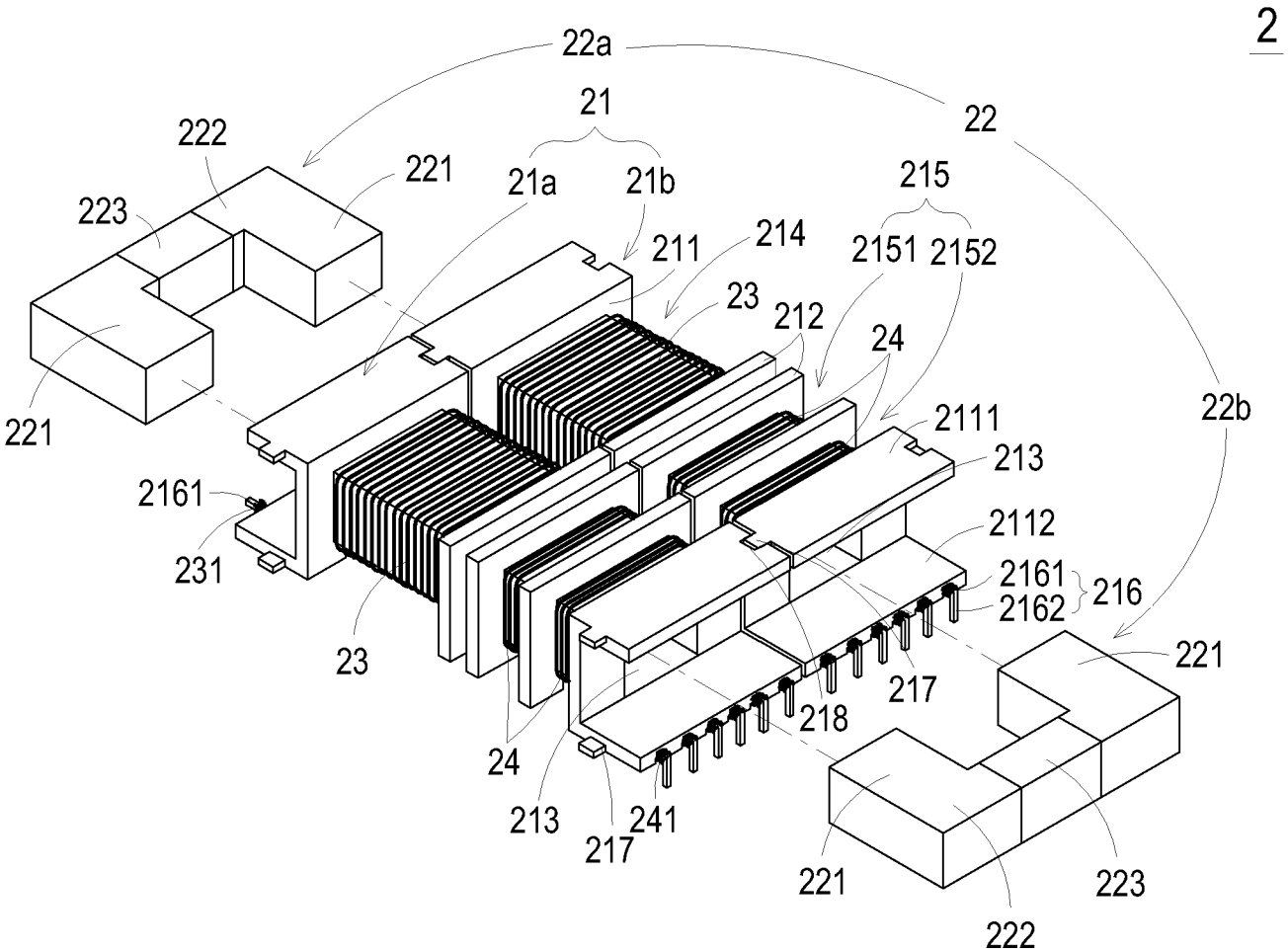
FIG. 2 is a schematic exploded view of a transformer according to a first preferred embodiment of the present invention.

FIG. 2 is a schematic exploded view of a transformer according to a first preferred embodiment of the present invention. As shown in FIG. 2, the transformer 2 principally comprises multiple bobbins 21, a magnetic core assembly 22, primary winding coils 23 and secondary winding coils 24. In this embodiment, the transformer comprises two bobbins 21*a*, 21*b*. The number of the bobbins can be varied in accordance with different demands. Besides, since the structures of bobbin 21*a* and bobbin 21*b* are substantially identical, only the bobbin 21*a* is taken as example for illustration in more details.

Figure 3:
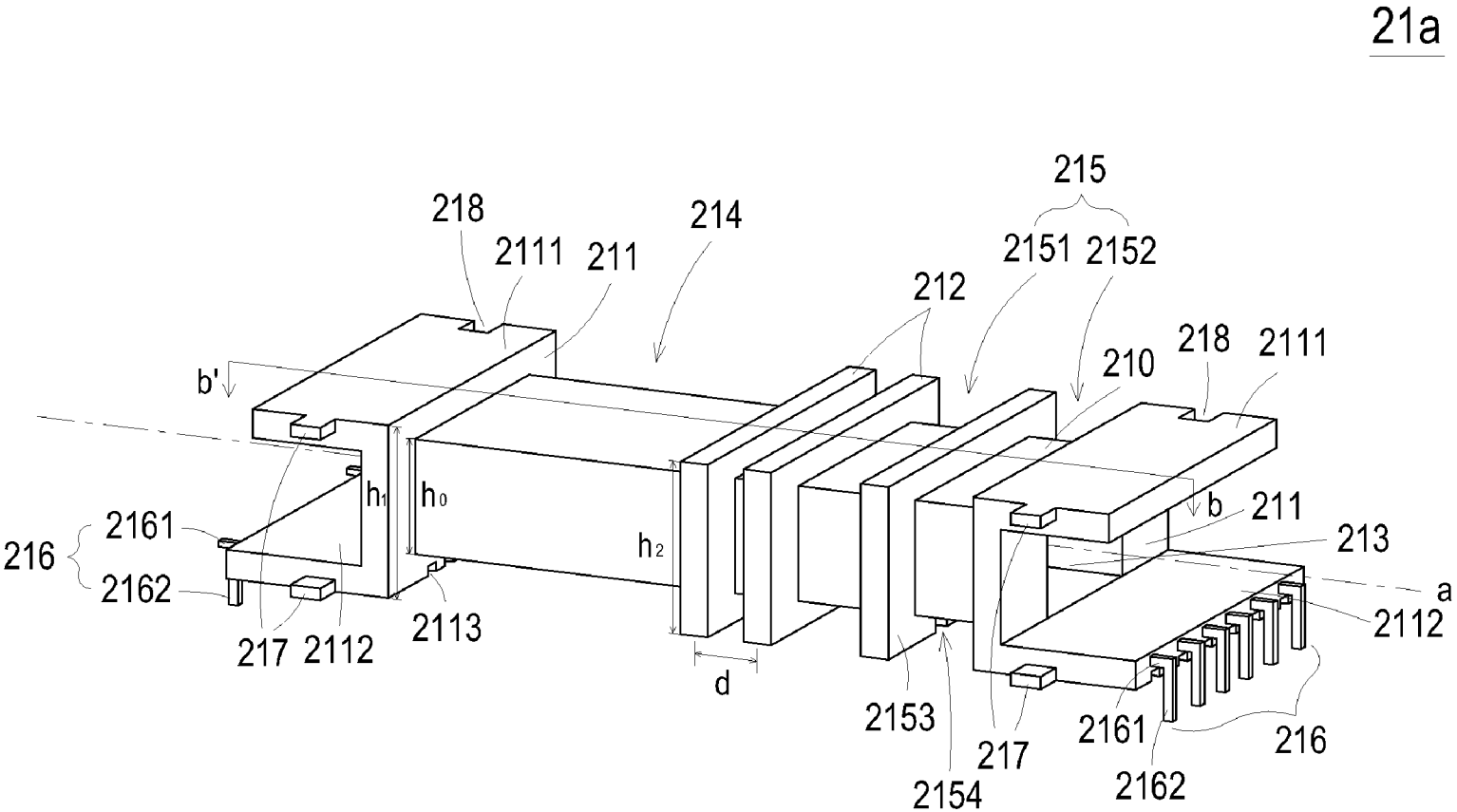
FIG. 3 is a schematic perspective view illustrating of the bobbin used in the transformer of FIG. 2.
Figure 5:
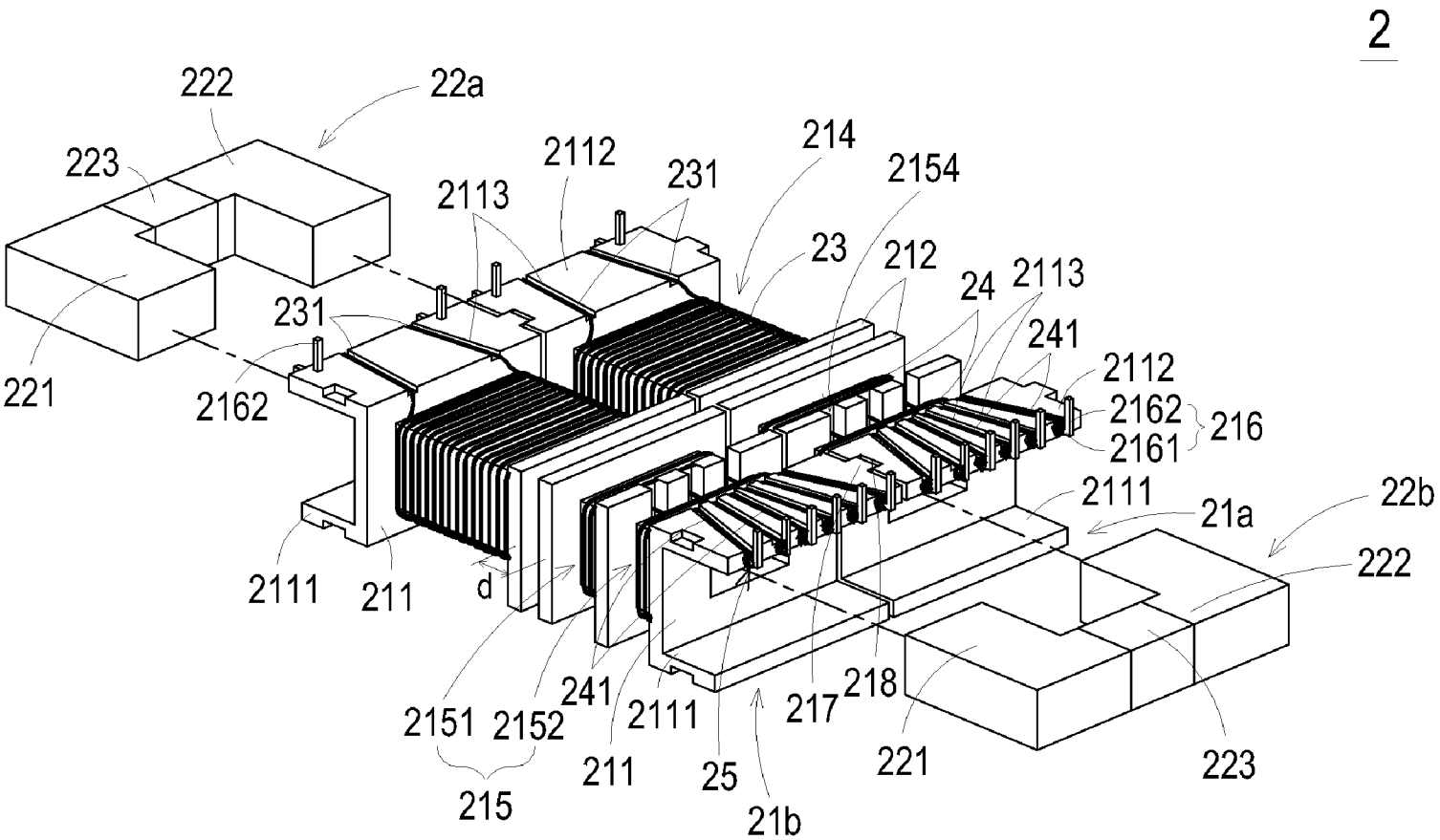
FIG. 5 is a schematic bottom view illustrating the transformer shown in FIG. 2.

FIG. 3 is a schematic perspective view illustrating of the bobbin used in the transformer of FIG. 2. As shown in FIG. 3, the bobbin 21*a* includes a main body 210, multiple sidewalls 211, multiple partition plates 212 and a channel 213. The main body 210 is a substantially cylinder tube with a rectangular cross-section. The width of the main body 210 is slightly larger than the height thereof. The bobbin 21*a* has two sidewalls 211, which are perpendicular to the longitudinal direction "a" of the main body 210 and mounted at two opposite sides of the main body 210. The partition plates 212 are disposed between the two side walls 211 and substantially parallel to these two side walls 211. In this embodiment, the bobbin 21*a* has two partition plates 212. The number of the partition plates 212 can be varied as required. In this embodiment, the height h1 of the sidewalls 211 and the height h2 of the partition plates 212 are substantially identical and are both higher than the height h0 of the main body 210. A first winding portion 214 is collectively defined by the left sidewall 211 and the adjacent partition plate 212. A second winding portion 215 is collectively defined by the right sidewall 211 and the adjacent partition plate 212. That is to say, the first winding portion 214 and the second winding portion 215 are separated by the partition plates 212. In addition, there is a gap d between the two partition plates 212. By changing the gap d, the separation distance between the first winding portion 214 and the second winding portion 215 is adjustable. In this embodiment, the second winding portion 215 further comprises a first region 2151 and a second region 2152 such that two secondary winding coils 254 can be wound thereon. The first region 2151 and the second region 2152 are separated by a separation plate 2153 having a recess 2154. For winding the secondary winding coil 24 on the second winding portion 215, the secondary winding coil 24 wound on the first region 2151 may be extended to the second region 2152 through the recess 2154 (as shown in FIG. 5).

Figure 4:
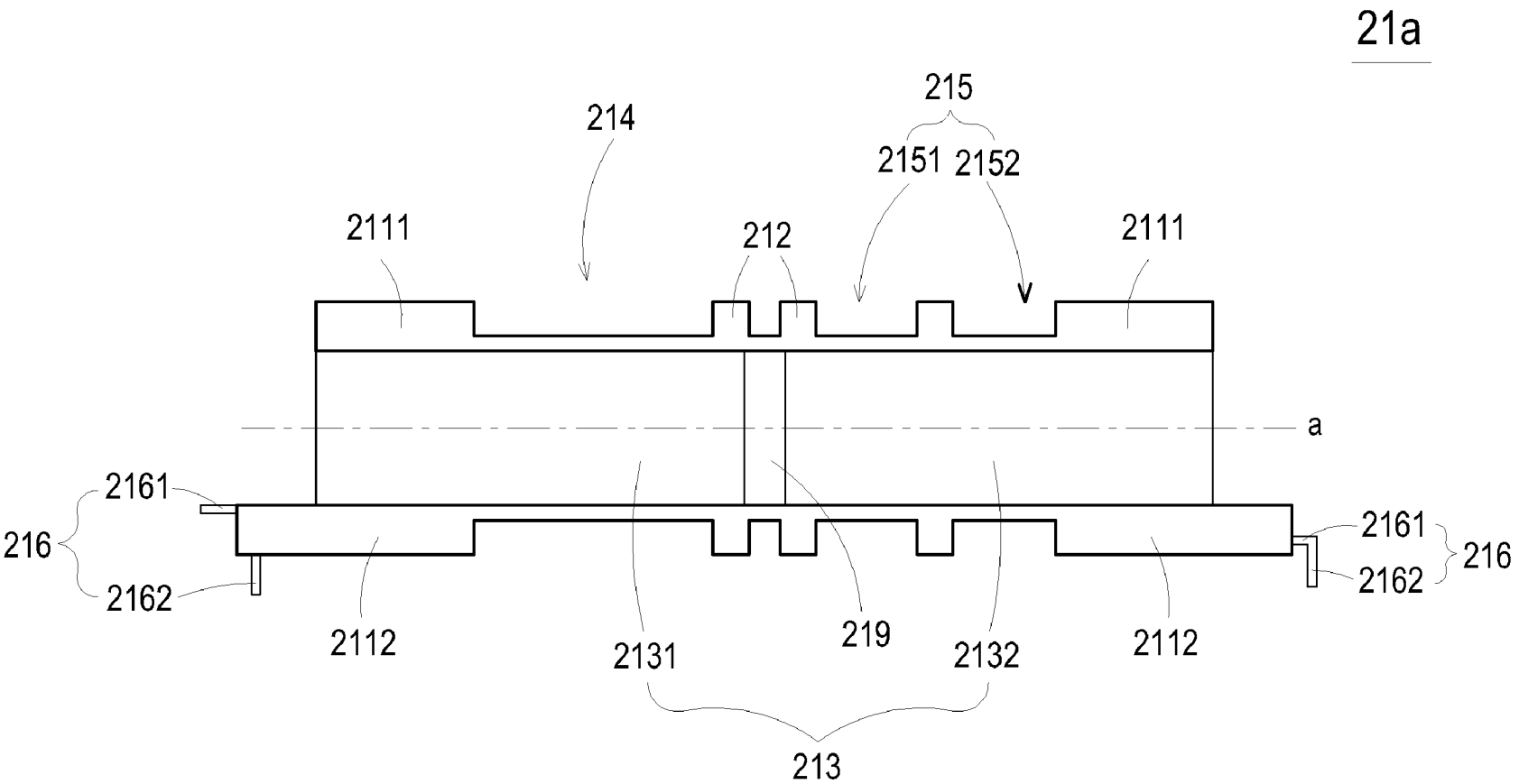
FIG. 4 is a schematic cross-section view of the bobbin shown in FIG. 3 taken along the line b-b'.
Figure 6:
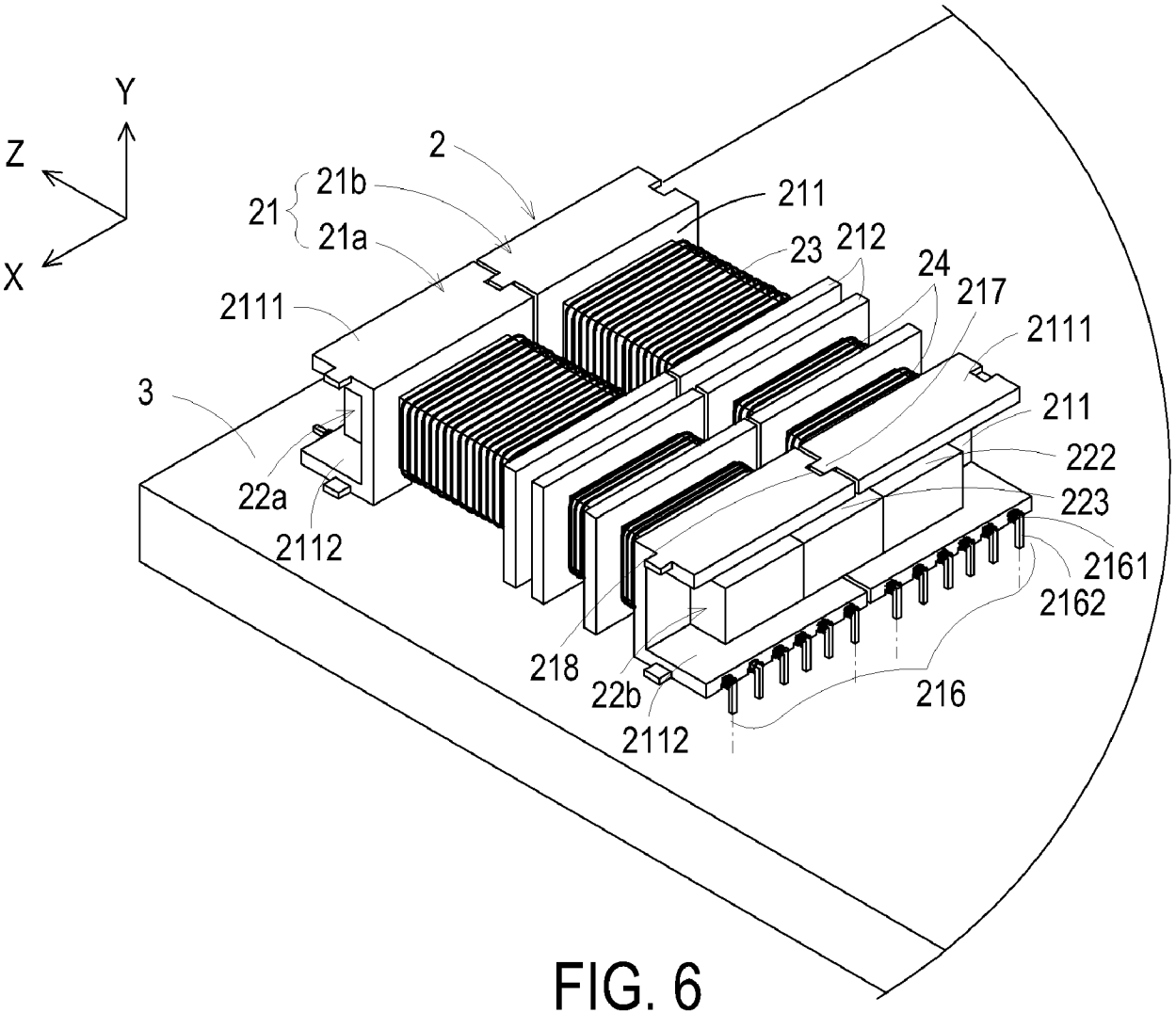
FIG. 6 is a schematic view illustrating the transformer of the present invention mounted on a circuit board.

FIG. 4 is a schematic cross-section view of the bobbin shown in FIG. 3 taken along the line b-b'. Please refer to FIGS. 3 and 4. The channel 213 of the bobbin 21*a* has a rectangular cross-section. The channel 213 is extended along the longitudinal direction "a" of the main body 210 and runs through the side walls 211 and the main body 210, so that the main body 210 is substantially a cylinder tube with a rectangular cross-section. As a consequence, the magnetic core assembly 22 may be partially embedded into the channel 213 (as shown in FIG. 6). Furthermore, a pacer 219 is located within the channel 213 of the bobbin 21*a*. The pacer 219 is arranged between the first winding portion 214 and the second winding portion 215 such that the channel 213 is divided into a first sub-channel 2131 and a second sub-channel 2132. As shown in FIG. 4, the pacer 219 is a rectangular plate. The cross-sectional area of the pacer 219 is substantially equal to that of the channel 213, so that the pacer 219 can be placed into the channel 213 through the entrance thereof and then sustained against the inner wall of the channel 213. In some embodiments, the pacer 219 is a bulge that has a cross-sectional area smaller than that of the channel 213 and is extended from an inner wall of the channel 213. In some embodiments, the pacer 219 is integrated into the main body 210. For example, the pacer 219 is a retaining wall of the channel 213. In other words, the pacer 219 is not limited to a specified shape as long as the channel 213 can be divided into the first sub-channel 2131 and the second sub-channel 2132 by the pacer 219. The pacer 219 is made of nonmagnetic material such as polyester resin (e.g. Mylar) or plastic material.

Please refer to FIG. 3 again. An upper plate 2111 and a lower plate 2112 are respectively extended from the top edge and the bottom edge of the sidewall 211 of the bobbin 21*a*. The upper plate 2111 and the lower plate 2112 are substantially perpendicular to the sidewall 211 such that a receptacle is collectively defined by the sidewall 211, the upper plate 2111 and the lower plate 2112 for partially accommodating the magnetic core assembly 22. In this embodiment, the main body 210, the sidewalls 211, the partition plates 212, the upper plate 2111 and the lower plate 2112 of the bobbin 21*a* are made of nonconductive material (e.g. plastic material) and integrally formed.

Besides, the bobbin 21*a* further comprises multiple pins 216. Each of the pins 216 may be divided into a connecting portion 2161 and a conducting portion 2162. The connecting portion 2161 and the conducting portion 2162 are substantially perpendicular to each other such that the pin 216 is L-shaped. The connecting portion 2161 and the conducting portion 2162 are made of conductive material, such as metals, e.g., copper, aluminum. It is preferably that the connecting portion 2161 and the conducting portion 2162 are integrally formed. In this embodiment, the pins 216 are mounted on the bobbin 21*a* in two forms. As for the pins 216 that are next to first winding portion 214, the connecting portions 2161 are horizontally extended from the lower plate 2112, the conducting portions 2162 are vertically extended from the lower plate 2112, and the junctions between the connecting portion 2161 and the conducting portions 2162 are buried in the lower plate 2112. As for the pins 216 that are next to first winding portion 214, the connecting portions 2161 are horizontally extended from the lower plate 2112 and connected to the conducting portions 2162, the conducting portions 2162 are vertically extended from the lower plate 2112, and the junctions between the connecting portion 2161 and the conducting portions 2162 are disposed outside the lower plate 2112. The output terminals 231, 241 of the primary winding coil 23 and the secondary winding coil 24 may be wound on the conducting portions 2162 of the pins 216 (as shown in FIG. 5). After the conducting portions 2162 of the pins 216 are welded on corresponding electrical contacts or conductive holes on a circuit board 3 (as shown in FIG. 6), the transformer 2 is structurally and electrically connected to the circuit board 3. It is noted that, however, those skilled in the art will readily observe that numerous modifications and alterations may be made while retaining the teachings of the invention. For example, all pins 216 of the bobbin 21*a* may have the same configuration.

Please refer to FIG. 2 and FIG. 3. As described above, the transformer 2 has two bobbins 21*a* and 21*b*. For combing these two bobbins 21*a* and 21*b* together, each of the bobbins 21*a* and 21*b* has several first engaging elements 217 and several second engaging elements 218. The first engaging elements 217 are formed on the upper plate 2111 and the lower plate 2112 at a side along the longitudinal direction "a" of the main body 210. Corresponding to the first engaging elements 217, the second engaging elements 218 are formed on the upper plate 2111 and the lower plate 2112 at the other side along the longitudinal direction "a" of the main body 210. In this embodiment, the first engaging elements 217 are protrusions, and the second engaging elements 218 are matched indentations. The bobbin 21*b* has an identical structure to bobbin 21*a*. After the first engaging elements 217 of the bobbin 21*b* are engaged with the second engaging elements 218 of the bobbin 21*a*, these two bobbins 21*a* and 21*b* are firmly combined together (as shown in FIGS. 2 and 5). It is noted that, however, those skilled in the art will readily observe that numerous modifications and alterations may be made while retaining the teachings of the invention. For example, the first engaging elements 217 and the second engaging elements 218 are respectively indentations and protrusions. Alternatively, the first engaging elements 217 and the second engaging elements 218 are other mutually matched engaging structures for facilitating combining these two bobbins 21*a* and 21*b* together in parallel. In addition, several grooves 2113 are formed in the lower surface (i.e. the surface facing the circuit board 3) of the lower plate 2112 for accommodating the output terminals 231, 241 of the primary winding coil 23 and the secondary winding coil 24, thereby positioning the output terminals 231 and 241 (as shown in FIG. 5).

FIG. 5 is a schematic bottom view illustrating the transformer shown in FIG. 2. Please refer to FIGS. 2 and 5. In addition to the bobbins 21, the transformer 2 also comprises the primary winding coil 23, the secondary winding coil 24 and the magnetic core assembly 22. The primary winding coil 23 is wound on the first winding portion 214 of each bobbin 21. The output terminals 231 of the primary winding coil 23 are partially accommodated in the grooves 2113 that are formed in the lower surface of the lower plate 2112, and then connected to the connecting portions 2161 of the pins 216 that are adjacent to the primary winding coil 23. In this embodiment, the output terminals 231 are wound on the connecting portions 2161 of the pins 216 for receiving input current from the circuit board 3 through the conducting portions 2162 and the connecting portions 2161 of the pins 216. Moreover, the secondary winding coil 24 is wound on the second winding portion 215 of the bobbin 21. The second winding portion 215 is divided into the first region 2151 and the second region 2152 so that each bobbin 21 is wound by two secondary winding coils 24. Similarly, the output terminals 241 are partially accommodated in the grooves 2113 that are formed in the lower surface of the lower plate 2112, and then connected to the connecting portions 2161 of the pins 216 that are adjacent to the secondary winding coils 24. As a consequence, the induced current produced from the electromagnetic induction between the secondary winding coils 24 and the primary winding coil 23 can be outputted to the circuit board 3 through the output terminals 241 and the connecting portions 2161 and the conducting portions 2162 of the pins 216. By means of soldering material, the output terminals 231 and 241 of the primary winding coil 23 and the secondary winding coils 24 can be welded on the connecting portions 2161 of the pins 216. As a consequence, the connections between the output terminals 231, 241 and the connecting portions 2161 of the pins 216 can be stronger to prevent the output terminals 231, 241 from being detached from the connecting portions 2161 of the pins 216.

Since the first winding portion 214 and the second winding portion 215 are separated by the partition plates 212, the electric safety distance between the primary winding coil 23 wound on the first winding portion 214 and the secondary winding coil 24 wound on the second winding portion 215 are kept by the gap d between the two partition plates 212. As such, the coupling coefficient between the first winding portion 214 and the secondary winding coil 24 is reduced. Moreover, since the connecting portions 2161 and the conducting portions 2162 of the pins 216 are substantially perpendicular to each other and the distal ends of the connecting portions 2161 or the junctions between the connecting portion 2161 and the conducting portions 2162 are buried in the lower plate 2112, the total height of the transformer 2 is reduced. Furthermore, since the output terminals 231 of the primary winding coil 23 and the output terminals 241 of the secondary winding coils 24 are wound on the connecting portions 2161 of the pins 216, the conducting portions 2162 of the pins 216 can maintain their integrity. Even if the junctions between the lower plate 2112 of the bobbin 21 and the connecting portions 2161 of the pins 216 are molten during the output terminals 231 and 241 are welded on the connecting portions 2161, the function of the transformer 2 will still not be significantly influenced.

Please refer to FIG. 2 again. The magnetic core assembly 22 includes a first magnetic core 22*a* and a second magnetic core 22*b*, which have substantially the same structure. In this embodiment, the magnetic cores 22*a* and 22*b* are U-shaped magnetic cores and the magnetic core assembly 22 is also referred as a UU-type magnetic core assembly. Each of the magnetic cores 22*a* and 22*b* has two core legs 221 and a core base 222. The core legs 221 are substantially perpendicular to the core base 222. The cross-section area of the core leg 221 is approximately identical to that of the channel 213 of the bobbin 21, so that the core legs 221 of the first magnetic core 22*a* and the second magnetic core 22*b* of the magnetic core assembly 22 can be accommodated in the channel 231 of the bobbin 21. It is noted that, however, the magnetic core assembly 22 may be varied according to number of the bobbins 21.

As known, when the primary winding coil 23 or secondary winding coil 24 discharges electricity, the two adjacent bobbins 21*a* and 21*b* are possibly electrically connected with each other through the magnetic core assembly 22 and thus the electric safety is impaired. For preventing the electric conduction between the two adjacent bobbins 21*a* and 21*b*, an insulating article 223 is partially sheathed around the core base 222 of each of the magnetic cores 22*a* and 22*b*. The use of the insulating article 223 provides a sufficient safety distance among the primary winding coil 23, the secondary winding coil 24 and the magnetic core assembly 22. The insulating article 223 is for example an insulating tape, an insulating lacquer, a rubber or any other nonconductive material. The range of the core base 222 covered by the insulating article 223 may be varied according to required electric safety standards.

In some embodiments wherein the pacer 219 is an integrated retaining wall to divide the channel 213 into the first sub-channel 2131 and the second sub-channel 2132, the insulating article 223 may be omitted because it is impossible to cause electric connection between the magnetic cores 22*a* and 22*b*.

FIG. 6 is a schematic view illustrating the transformer of the present invention mounted on a circuit board. Hereinafter, a process of assembling a transformer according to a preferred embodiment of the present invention will be illustrated with reference to FIGS. 2, 4 and 6. First of all, the primary winding coils 23 and the secondary winding coils 24 are respectively wound on the first winding portions 214 and the second winding portions 215 of the bobbins 21*a* and 21*b*. Then, the output terminals 231 and 241 are partially accommodated in the grooves 2113 and wound on the connecting portions 2161 of the pins 216. Then, the first engaging elements 217 of the bobbin 21*b* are engaged with the second engaging elements 218 of the bobbin 21*a*, so that these two bobbins 21*a* and 21*b* are firmly combined together. Then, the core legs 221 of the magnetic core 22*a* are embedded into the first sub-channels 2131 of the bobbins 21*a* and 21*b* such that the core legs 221 are sustained against the spacers 219. At the same time, the core base 222 of the magnetic core 22*a* is partially accommodated within the receptacles defined by the sidewalls 211, the upper plates 2111 and the lower plates 2112 of the bobbins 21*a* and 21*b* such that the core base 222 of the magnetic core 22*a* is supported by the lower plates 2112. Similarly, the core legs 221 of the magnetic core 22*b* are embedded into the second sub-channels 2132 of the bobbins 21*a* and 21*b* such that the core legs 221 are sustained against the spacers 219. At the same time, the core base 222 of the magnetic core 22*b* is partially accommodated within the receptacles defined by the sidewalls 211, the upper plates 2111 and the lower plates 2112 of the bobbins 21*a* and 21*b*. Thus, the transformer 2 of the present invention is completed. After the conducting portions 2162 of the pins 216 are welded on corresponding electrical contacts or conductive holes on a circuit board 3, the transformer 2 is structurally and electrically connected to the circuit board 3.

Since the core legs 221 of the magnetic cores 22*a* and 22*b* are sustained against the spacers 219 within the channels 213 of the bobbins 21*a* and 21*b*, the leakage inductance of the transformer 2 is adjusted by the thickness of the spacer 219. In this embodiment, the thickness of the spacer 219 is ranged from 0.3 mm to 0.5 mm. It is noted that, however, the thickness of the spacer 219 may be varied as required. Furthermore, the core legs 221 of the magnetic cores 22*a* and 22*b* are embedded into the channels 213 of the bobbins 21*a* and 21*b* and the core bases 222 of the magnetic cores 22*a* and 22*b* are partially covered by the insulating articles 223. That is, since the core bases 222 located between two channels 213 of two adjacent bobbins 21 are covered by the insulating articles 223, the creepage distance from the primary winding coil 23 to the magnetic core assembly 22 is increased. As shown in FIG. 6, the creepage distances in X and Z directions from the primary winding coil 23 to the magnetic core assembly 22 can be increased by means of the sidewalls 211 and insulating articles 223; and the creepage distances in Y and Z directions can be increased by means of the sidewalls 211, the upper plates 2111 and the lower plates 2112. Similarly, the creepage distances between the secondary winding coils 24 and magnetic core 22*b* can also be increased.

Furthermore, the transformer 2 has substantially L-shaped pins 216. The output terminals 231 of the primary winding coil 23 and the output terminals 241 of the secondary winding coils 24 are wound on the connecting portions 2161 of the pins 216. The conducting portions 2162 of the pins 216 are welded on corresponding electrical contacts or conductive holes on a circuit board 3. Therefore, the total height of the transformer 2 is reduced and the conducting portions 2162 of the pins 216 can maintain their integrity.

Figure 7:
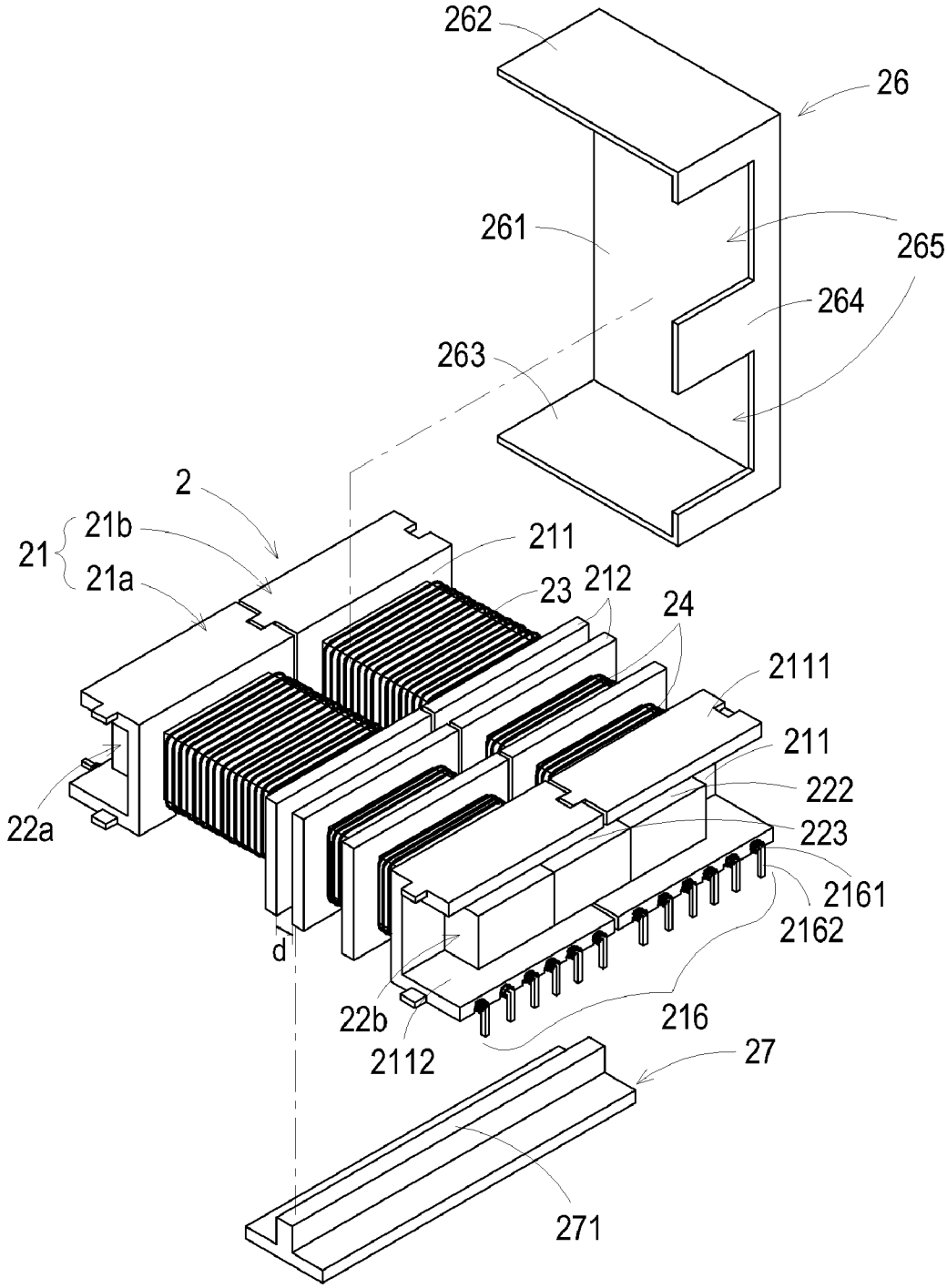
FIG. 7 is a schematic exploded view of a transformer according to a second preferred embodiment of the present invention.

For further isolating the primary winding coil 23 from the secondary winding coils 24 and thus increasing electric safety of the transformer 2, the transformer 2 may optionally include an upper covering member and a lower covering member. FIG. 7 is a schematic exploded view of a transformer according to a second preferred embodiment of the present invention. In comparison with the transformer 2 shown in FIG. 2, the structure of transformer of this embodiment further comprises an upper covering member 26 and a lower covering member 27. As shown in FIG. 7, the upper covering member 26 comprising a covering plate 261, a first side plate 262, a second side plate 263 and a third side plate 264. The first side plate 262, the second side plate 263 and the third side plate 264 are vertically extended from three edges of the covering plate 261. The third side plate 264 has two notches 265. The lower covering member 27 has a protruded rib 271 such that the lower covering member 27 is formed as a T-shaped structure. For combining the upper covering member 26 with the bobbins 21*a* and 21*b*, the primary winding coils 23 are sheltered by the covering plate 261, the first side plate 262 and the second side plate 263 of the upper covering member 26; and the third side plate 264 is inserted into the gap d between two partition plates 212 while the notches 265 partially enclose the main bodies 210 of the bobbins 21*a* and 21*b*. Meanwhile, the upper covering member 26 is horizontally combined with the bobbins 21*a* and 21*b*. In addition, the protruded rib 271 is also inserted into the gap d between two partition plates 212. As a consequence, the uses of the upper covering member 26 and the lower covering member 27 may facilitate isolating the primary winding coil 23 from the secondary winding coils 24 without largely increasing the overall height of the transformer 2.

Figure 8:
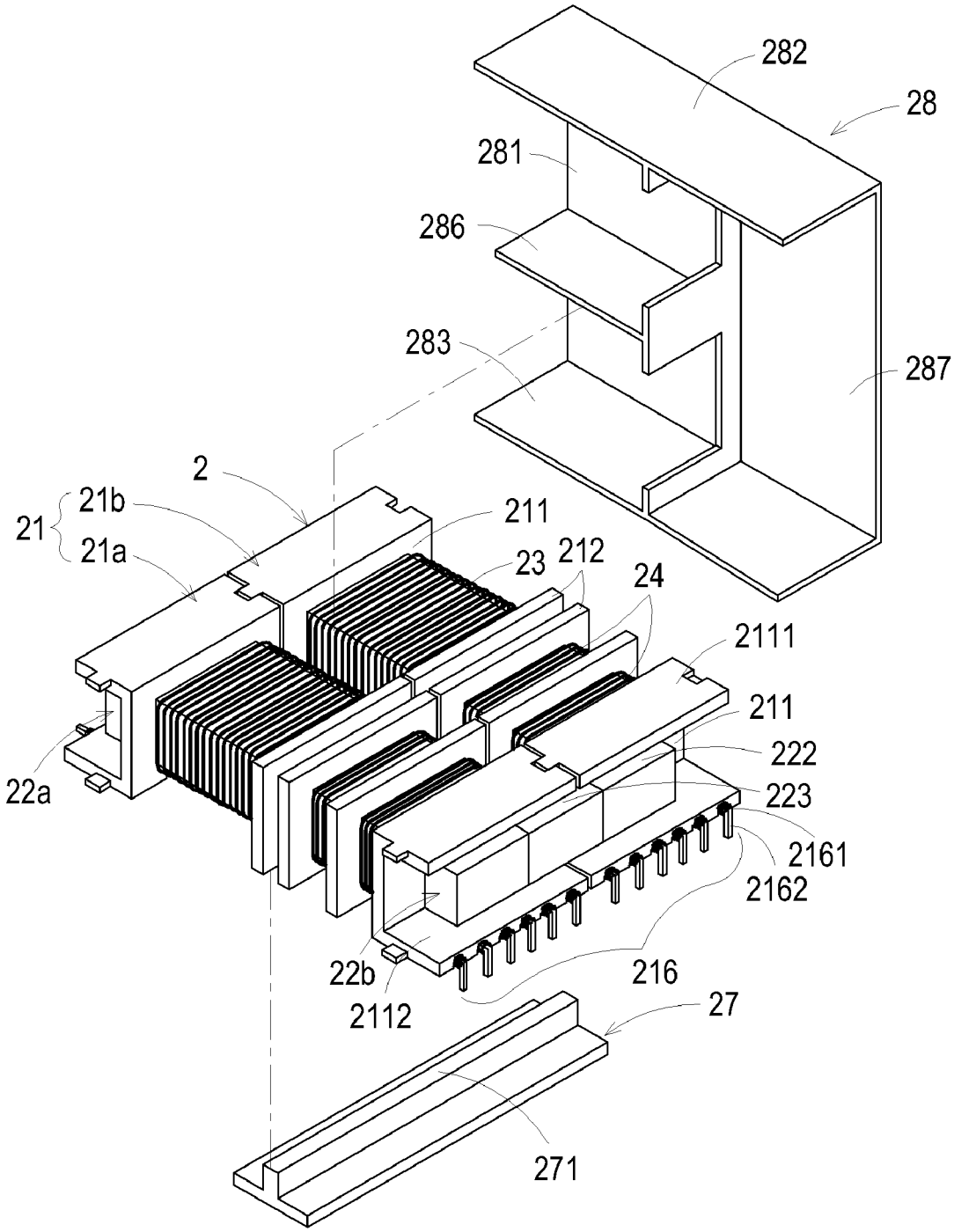
FIG. 8 is a schematic exploded view of a transformer according to a third preferred embodiment of the present invention.

FIG. 8 is a schematic exploded view of a transformer according to a third preferred embodiment of the present invention. As shown in FIG. 8, the upper covering member 28 comprises a covering plate 281, a first side plate 282, a second side plate 283, a third side plate 284, a first extension plate 286 and a second extension plate 287. The first side plate 282 and the second side plate 283 are vertically extended from two opposite edges of the covering plate 281. The third side plate 284 has two notches. The first extension plate 286 is also disposed on the covering plate 281 and parallel to and between the first side plate 282 and the second side plate 283. The second extension plate 287 is extended from the covering plate 281, the first side plate 282 and the second side plate 283. For combining the upper covering member 28 with the bobbins 21*a* and 21*b*, the primary winding coils 23 are sheltered by the covering plate 281, the first side plate 282, the second side plate 283 and the first extension plate 286 of the upper covering member 28; the third side plate is inserted into the gap d between two partition plates 212 while the notches partially enclose the main bodies 210 of the bobbins 21*a* and 21*b*; and the secondary winding coils 24 are sheltered by the second extension plate 287. In addition, the protruded rib 271 is also inserted into the gap d between two partition plates 212. As a consequence, the uses of the upper covering member 28 and the lower covering member 27 may facilitate isolating the primary winding coil 23 from the secondary winding coils 24 without largely increasing the overall height of the transformer 2.

In the above embodiments, the present invention is illustrated by referring to a transformer having two bobbins. Nevertheless, the transformer may have three or more bobbins. In a case that the transformer may have three bobbins, the magnetic core assembly used in the present invention may be an EE-type magnetic core assembly, wherein each magnetic core of the EE-type magnetic core assembly includes a core base and three core legs. An insulating article is partially sheathed around the core base between every two adjacent core legs. The three core legs are embedded into respective channels of the three bobbins. The use of the insulating article can increase the creepage distances between the primary winding coil, the secondary winding coils and the magnetic core assembly. The respective channels of the three bobbins have spacers such that the core legs are sustained against the spacers. By adjusting the thickness of the spacer, the leakage inductance of the transformer is controllable.

The number of the bobbins used in the transformer of the present invention may be varied as long as the core legs of the magnetic core assembly are sustained against the spacers within the channels and the insulating article is partially sheathed around the core base between every two adjacent core legs. As a consequence, the leakage inductance of the transformer is controllable and the creepage distances between the primary winding coil, the secondary winding coils and the magnetic core assembly are increased.

From the above description, since the core legs of the magnetic core assembly are sustained against the spacers within the channels of the bobbins, the core legs within the channels are separated by respective spacers. In addition, since the insulating article is partially sheathed around the core base between every two adjacent core legs and the core bases of the magnetic core assembly are sheltered by the upper plates and the lower plates, the creepage distances between the primary winding coil, the secondary winding coils and the magnetic core assembly are increased. Accordingly, the leakage inductance of the transformer is controllable and the electric safety is enhanced. Furthermore, the primary winding coil and the secondary winding coils are separated by the partition plates in order to enhance the electric safety. The transformer may optionally include an upper covering member and a lower covering member in order to isolate the primary winding coil from the secondary winding coils and thus increasing electric safety of the transformer. In comparison with the conventional transformer, the transformer of the present invention has controllable leakage inductance and increased electric safety.

Moreover, since the connecting portions and the conducting portions of the pins are substantially perpendicular to each other and the distal ends of the connecting portions or the junctions between the connecting portion and the conducting portions are buried in the lower plate, the total height of the transformer is reduced. Furthermore, since the output terminals of the primary winding coil and the secondary winding coils are wound on the connecting portions of the pins, the conducting portions of the pins can maintain their integrity. Even if the junctions between the lower plate of the bobbin and the connecting portions of the pins are molten during the output terminals are welded on the connecting portions, the function of the transformer will still not be significantly influenced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A transformer comprising:

multiple bobbins arranged side by side, wherein each bobbin comprises:

a main body having at least two sidewalls respectively disposed at two opposite ends thereof;

multiple partition plates disposed on said main body for respectively cooperating with said sidewalls to define a first winding region and a second winding region, wherein said first winding region and said second winding region are separated by said partitions plates;

a channel running through said sidewalls and said main body; and a spacer disposed within said channel;

a primary winding coil wound on said first winding portion of each bobbin;

a secondary winding coil wound on said second winding portion of each bobbin; and a magnetic core assembly comprising a first magnetic core and a second magnetic core, wherein each of said first magnetic core and said second magnetic core comprises a core base and several core legs, said core legs are perpendicular to said core base, said core legs are partially embedded into said channels of said bobbins and sustained against said spacers, and an insulating article is partially sheathed around said core base between every two adjacent core legs.

2. The transformer according to claim 1 wherein an upper plate and a lower plate are respectively extended from a top edge and a bottom edge of said sidewall of said bobbin.

3. The transformer structure according to claim 2 wherein each bobbin further comprises multiple pins extended from each lower plate for mounting on and electrically connecting to a circuit board.

4. The transformer structure according to claim 3 wherein each pin includes a connecting portion and a conducting portion, wherein said connecting portions of said pins are partially embedded in said lower plates, horizontally extended from said lower plates and connected to multiple output terminals of said primary winding coil and said secondary winding coil, and said conducting portions of said pins are substantially perpendicular to the connecting portions and mounted on said circuit board.

5. The transformer structure according to claim 4 wherein several grooves are formed in each lower surface for accommodating and positioning said output terminals of said primary winding coil and said secondary winding coil.

6. The transformer structure according to claim 1 wherein each bobbin has a first engaging element and a second engaging element, and every two adjacent bobbins are combined together through engagement between said first engaging element and said second engaging element of respective and adjacent bobbins.

7. The transformer structure according to claim 1 wherein said transformer further comprises an upper covering member and a lower covering member.

8. The transformer structure according to claim 1 wherein said insulating article is an insulating tape or an insulating lacquer.

9. The transformer structure according to claim 1 wherein said spacer is made of nonmagnetic material, and said spacer is integrally formed with said main body.

10. The transformer structure according to claim 1 wherein said partition plates are parallel to said sidewalls, the heights of said sidewalls and said partition plates are higher than the height of said main body, and said sidewalls and said partition plates are integrally formed with said main body.

11. The transformer structure according to claim 1 wherein said transformer comprises two bobbins and the magnetic core assembly is a UU-type magnetic core assembly.

12. The transformer structure according to claim 1 wherein said transformer is a LLC transformer.

* * * * *